US009480626B2

(12) United States Patent
Rohrig

(10) Patent No.: US 9,480,626 B2
(45) Date of Patent: Nov. 1, 2016

(54) TEETHING DEVICE

(75) Inventor: Peter Rohrig, Vienna (AT)

(73) Assignee: MAM BABYARTIKEL GESELLSCHAFT M.B.H., Vienna (AT)

( * ) Notice: Subject to any disclaimer, the term of this patent is extended or adjusted under 35 U.S.C. 154(b) by 1015 days.

(21) Appl. No.: 13/512,127

(22) PCT Filed: Nov. 24, 2010

(86) PCT No.: PCT/AT2010/000459

§ 371 (c)(1),
(2), (4) Date: May 25, 2012

(87) PCT Pub. No.: WO2011/063440

PCT Pub. Date: Jun. 3, 2011

(65) Prior Publication Data

US 2012/0290007 A1 Nov. 15, 2012

(30) Foreign Application Priority Data

Nov. 27, 2009 (AT) ..... GM752/2009

(51) Int. Cl.
*A61J 17/02* (2006.01)
*A61J 17/00* (2006.01)

(52) U.S. Cl.
CPC ..... *A61J 17/02* (2013.01); *A61J 17/00* (2013.01)

(58) Field of Classification Search
CPC .... A61J 17/02; A61J 17/00; A61J 2017/001; A61J 2017/002; A61J 2017/003; A61J 2017/004; A61J 2017/005; A61J 2017/006; A61J 2017/007; A61J 2017/008; A61J 9/00; A61J 9/001; A61J 9/005; A61J 9/006; A61J 9/008; A61J 9/04; A01K 15/025; A01K 15/026; A61H 13/00; A63H 33/006; A61F 11/005; A61F 11/001; A61F 11/0015; A61F 11/002; A61F 11/0025; A61F 11/003; A61F 11/0035; A61F 11/004; A61F 11/0045; A61F 11/0055; A61F 11/006; A61F 11/0065; A61F 11/007; A61F 11/04; A61F 11/045
USPC ..... 606/234, 235; 119/702, 709–711; 446/227, 267, 421; D24/194; 215/11.1–11.6
See application file for complete search history.

(56) References Cited

U.S. PATENT DOCUMENTS 2,408,735 A 10/1946 Claflin
4,655,723 A * 4/1987 Marason et al. ..... 446/241

(Continued)

FOREIGN PATENT DOCUMENTS

JP 200626440 * 2/2006
WO 2009/002535 A2 12/2008

OTHER PUBLICATIONS

International Search Report: mailed Mar. 17, 2011; PCT/AT2010/000459.

*Primary Examiner* — Katrina Stransky
*Assistant Examiner* — Katherine Schwiker
(74) *Attorney, Agent, or Firm* — Ladas & Parry LLP

(57) ABSTRACT

Teething device for an infant, with a substantially arc-shaped and elastically deformable teething element having two free end areas spaced apart from each other in an unloaded rest position, wherein the teething element forms a free gap between the end areas in the rest position and is substantially circular, and the arc-shaped teething element substantially simulates the shape of the jaw in such a way that, when it is inserted into the mouth and is substantially congruent with the jaw, the end areas are arranged in the area of the molars in the rest position of the teething element, wherein the free gap has an opening angle of between 15° and 35°, measured from the internal apex of the opening, and the arc-shaped teething element is elastically deformable in such a way that the two end areas can be arranged at least partially overlapping each other in a securing position.

13 Claims, 3 Drawing Sheets

(56) References Cited

U.S. PATENT DOCUMENTS

| | | | | |
|---|---|---|---|---|
| 7,857,831 | B2 * | 12/2010 | Ishikawa et al. | 606/234 |
| 2004/0210252 | A1 * | 10/2004 | Minoguchi et al. | 606/234 |
| 2005/0004603 | A1 * | 1/2005 | Desousa et al. | 606/235 |
| 2005/0217159 | A1 * | 10/2005 | Leung | A47G 1/0616 40/725 |
| 2009/0076548 | A1 | 3/2009 | Letsche | |
| 2009/0249571 | A1 * | 10/2009 | Rohrig | 15/167.2 |

* cited by examiner

TEETHING DEVICE

The invention relates to a teething device for an infant, with a substantially arc-shaped and elastically deformable teething element having two free end areas spaced apart from each other in an unloaded rest position, wherein the teething element forms a free gap between the end areas in the rest position and is substantially circular annular.

A plurality of teething devices is available commercially, mainly intended to support the dentition of infants. Furthermore, the teething devices have a calming effect on the infant and serve to satisfy the natural biting impulse at this age. The teething devices are adapted to stimulate the perfusion of the gum and to accelerate dentition.

A teething device is known from JP 2006 026440 A, comprising a part being bent in the shape of an arc and being made of an elastic material. Protrusions and/or troughs are removably arranged on the arc-shaped part. The end areas of the arc-shaped part are separated by a narrow gap. This comparably narrow gap may, however, lead to disadvantageous breathing problems if the teething device is arranged congruently with the jaw.

DE 71 22 982 U describes a teething ring made of an elastically resilient plastic material, which is opened in one location by a transverse slot. The ring may be combined with other rings to form chains or the like. This means that a very narrow gap between the end areas of the teething ring is provided here as well and may make breathing difficult when arranging the teething ring within the oral cavity as intended.

Furthermore, arc-shaped teething elements with a shape adapted to fit the substantially U-shaped arrangement of teeth in the front area of the mandible or maxilla are known from the prior art. A U-shaped teething element of this type with two substantially straight free end areas extending parallel to each other is known from US 2005/0080456 A1, for example. Basically, the teething element shown is well suited for supporting dentition in the front area of the jaw; the molars at the back, however, are not stimulated sufficiently by this embodiment of the teething element with comparably short, nearly parallel end areas. A further drawback of this teething element is that it requires a shield to be attached to the teething element in order to avoid danger for the infant by the substantially rigid, straight end areas of the teething element, which might enter the throat and/or be swallowed by accident.

Furthermore, teething rings in the shape of closed tori are known from the prior art. EP 1 158 949 B1, for example, describes a handle for a pacifier which is designed as a teething ring. Designing the teething device as a teething ring also has the drawback that the molars at the back cannot be reached properly, so dentition in this region is not supported. Moreover, the closed shape results in a comparably rigid, inflexible arrangement, deteriorating the teething or chewing experience for the infant.

Finally, a teething ring filled with a gel is known from U.S. Pat. No. 5,782,868, ensuring flexibility over a wide range of temperatures by selecting the gel. This teething ring may be cooled or heated in order to cool or warm selected regions in the infant's mouth.

Considering all of the above, it is the object of the present invention to create a teething device of the initially mentioned type for supporting dentition in various ways, in particular stimulating the molars at the back as well while reliably preventing danger for the infant due to the teething element entering too far into the throat area and/or the teething element being swallowed down.

In the teething device of the initially mentioned type, this is achieved by the arc-shaped teething element substantially simulating the shape of the jaw in such a way that, when it is inserted into the mouth and is substantially congruent with the jaw, the end areas are arranged in the area of the molars in the rest position of the teething element, wherein the free gap has an opening angle of between 15° and 35°, measured from the apex of the interior wall of the opening, and the arc-shaped teething element is elastically deformable in such a way that the two end areas can be arranged at least partially overlapping each other in a securing position.

According to this, the two end areas of the teething element are spaced apart from each other in such a way that in an unloaded rest position a small distance—in comparison to known arc-shaped teething devices—is provided between the end areas since the shape is a closed arc, in contrast to known teething elements, in order to reach the molars at the back. Consequently there will be arc-shaped sections with comparably large dimensions, seen from the apex of the arc-shaped teething element, so the molars can be reached even if the arc-shaped teething element is only inserted into the oral cavity on one side, i.e. the cheek is received in the gap between the free ends of the teething element. In case of this type of insertion on one side there is no danger of inserting the teething element too far into the throat area at all. Provided that the arc-shaped teething element is received within the mouth in its entirety, i.e. used as intended, the molars at the back can be reached here as well. If, however, the arc-shaped teething element is pushed into the throat area far enough for the end areas to get behind the molars, the fact that the oral cavity is getting more narrow towards the back will effect lateral pressure to be applied to the free end areas, so the elastically deformable end areas will first move closer to each other and finally pass into the overlapping securing position before the end areas could enter the throat area and pose danger for the infant. In their securing position, the overlapping end areas are under tension and are trying to revert to their initial rest position once the lateral pressure to the end areas is relieved. This way, an unpleasant or even dangerous entering of the teething element into the infant's throat and/or airway may be prevented without the need for additional protective parts; in particular, there is no need for a shield to be positioned at the oral area, which is common with conventional teething devices and/or pacifiers. Since the molars at the back are also reached easily by this embodiment of the teething element, the entire jaw of the infant may be stimulated at the same time; this provides for a very thorough way of supporting dentition.

A good stimulation of the entire jaw, in particular the molars at the back, is achieved by the arc-shaped teething element substantially simulating the shape of the jaw in such a way that, when it is inserted into the mouth and is substantially congruent with the jaw, the end areas are arranged in the area of the molars in the rest position of the teething element. If the teething element is inserted further into the throat area, beyond its rest position, pressure applied to the end areas by the cheeks increases, thereby pushing the elastically deformable end areas into their overlapping securing position.

In order to combine a very good stimulation of the molars at the back with a reliable transition to the securing position, it is provided for the teething element, which is substantially circular annular and forms a free gap between the end areas in the rest position, to have the free gap with an opening angle of between 15° and 35°, in particular substantially 22°, measured from the apex of the interior wall of the opening.

In order to facilitate dentition and further enhance the haptic experience while chewing the teething element, it is favourable for the teething element to comprise elevated structural elements, preferably knobs or elongated protrusions. The structural elements are preferably formed integrally with the surface of the teething element.

A teething element with a high elastic deformability can be obtained if the teething element is hollow-bodied. Considering cost-efficient production, it is favourable for the hollow body to be made of a plastic, in particular polyolefins, thermoplastic elastomers, polyvinylidene chloride or silicone.

In order to guarantee a pleasant teething experience for the infant, it is an advantage for the hollow body to be filled with a liquid, in particular gel. The rigidity of the teething element may thus be adjusted by selecting an appropriate volume of liquid.

To avoid danger to the infant in case of a damaged hollow body, it is advantageous for the liquid to be non-hazardous to health. Regarding cost-efficient production, using water as the liquid is particularly beneficial.

According to a particularly preferred embodiment, a teething device with various teething elements and toy elements is provided by arranging the arc-shaped teething element together with at least two additional elements on a central attachment member, wherein the longitudinal planes of both the teething element and the two additional elements are arranged at an angle other than 180° in relation to the longitudinal plane of the attachment member. The attachment member may be an integral piece made of plastic, to which the individual elements are attached. The connection between the elements and the plastic piece is preferably non-releasable; a releasable attachment might be feasible as well, however. By arranging the elements in an angular fashion in relation to the attachment member, a space is formed below the attachment member and/or the elements connected to it when the teething device is positioned on a planar surface, so a user can reach into the space to pick the teeting device up; this makes it very easy, especially for infants, to pick up the device. Designing the teething device to have three elements, comprising the teething element and two additional elements, provides for a particularly stable placement of the teething device on the planar surface. Of course, however, the arc-shaped teething element according to the invention may also be an individual element, connected to and/or formed integrally with any attachment member or handle.

Using a teething ring as an additional element is favourable, since this provides for a particularly versatile teething device. Preferably, elevated structural elements to support dentition are provided on the teething ring. Solid teething rings, in particular, are preferably manufactured from a plastic.

In order to make the infant use the teething device frequently, it is favourable to provide a toy element in the form of a rotatably supported ball as an additional element. Considering a simple construction of the teething device, it is favourable for the ball to be supported within a ring that is integral with the attachment member. A motivational optical effect when rotating the ball may be obtained for the infant by using a multi-coloured ball.

The teething device can have a particularly stable arrangement during placement on a planar surface if the elements are draped around the connecting member in a symmetrical fashion. According to this, the three elements are arranged around a central axis of the attachment member, preferably offset by approximately 120° each.

By designing the attachment member, the arc-shaped teething element and at least portions of the additional elements as two-component or multi-component injection moulded parts, a non-releasable connection is guaranteed between the attachment member and the arc-shaped teething element and/or at least portions of the additional elements. In this case, the attachment member and an annular holder for accommodating a rotatable ball may be made of a harder material than the arc-shaped teething element and a teething ring, for example.

The invention will now be discussed in more detail by means of preferred exemplary embodiments illustrated in the drawings, however, without being restricted thereto.

Figure 1:
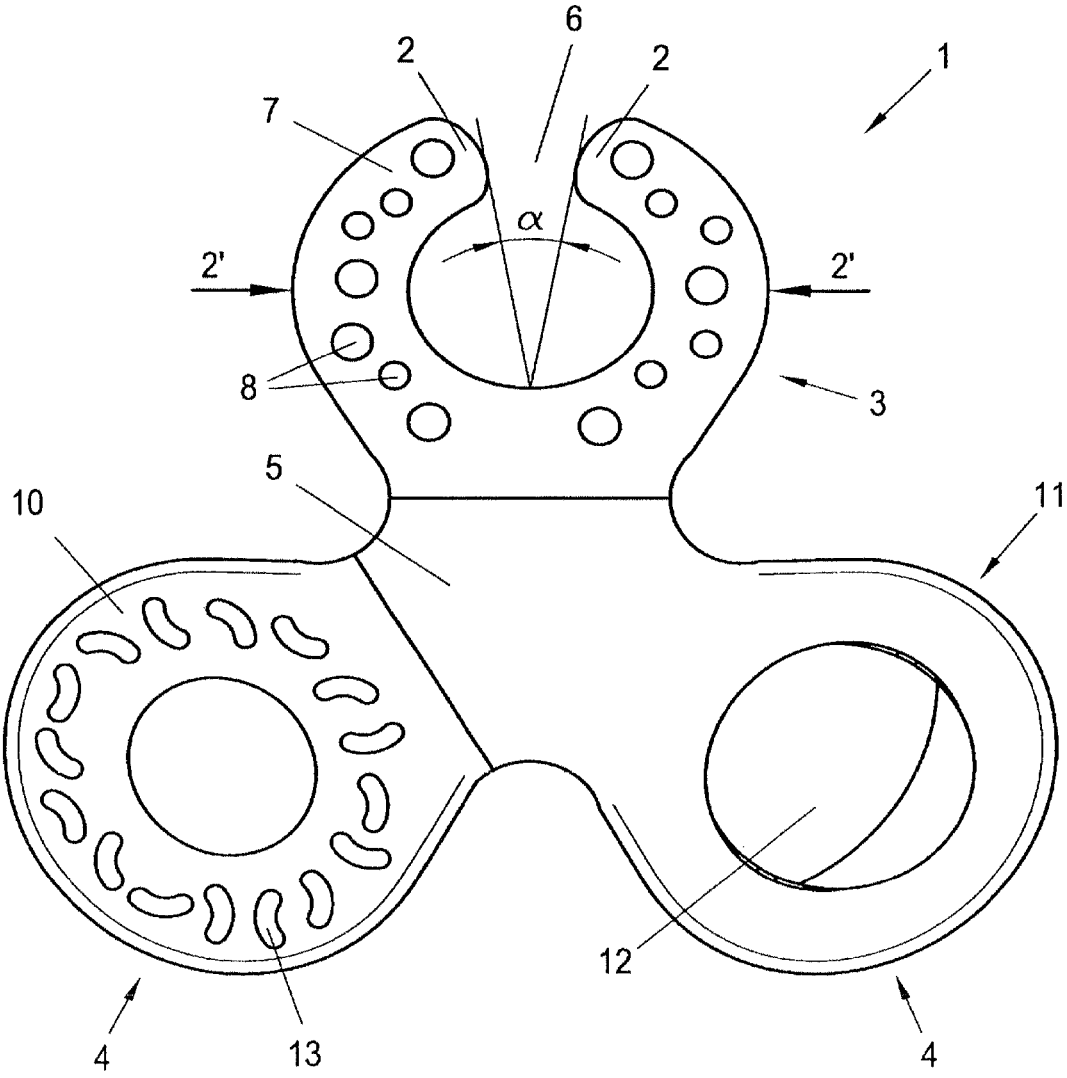
FIG. 1 shows a plan view of a teething device with a central attachment member, to which an arc-shaped teething element in an unloaded rest position as well as two additional elements are connected.

FIGS. 1 to 4 show a teething device 1 according to a particularly preferred embodiment of the invention, wherein an arc-shaped teething element 3, forming two free end areas 2, as well as two additional elements 4 are attached to a central attachment member 5.

The arc-shaped teething element 3 is shown in its unloaded rest position in FIG. 1, in which the free end areas 2 are arranged spaced apart from each other by a narrow gap 6 with a clear width of approximately 8 mm. An opening angle $\alpha$ of the free gap 6 has approximately 22°, measured from the apex of the interior wall of the teething element 3. The end areas 2 of the teething element 3 have a comparably sharp curvature, so the nearly circular annular teething element 3 is especially suitable for specifically stimulating the complete jaw, in particular the molars at the back as well.

Provided that the teething element is inserted into the mouth substantially congruent with the jaw, the sections adjacent to the free end areas 2 are substantially arranged in the region of the molars, so a reliable stimulation in this region of the jaw is guaranteed as well.

A lateral load applied to the end areas 2 in the direction of arrow 2', bringing them closer together, occurs particularly when the teeth element 3 that has been received by the mouth is pushed deeper into the throat area from its rest position, which is adapted to supporting dentition, so the oral cavity, which is getting narrower at the back, applies increasing pressure to the free end areas 2. When pushing the end areas 2 forward beyond the molars into the throat area, the two end areas 2 move closer to each other as well and finally pass into the securing position illustrated in FIGS. 2 to 4, where the end areas 2 are arranged partially overlapping each other.

A possibly dangerous entering of the end areas 2 into the throat area and/or a swallowing of the end areas 2 are reliably prevented in the securing position. The overlapping end areas 2 are under tension while in the securing position, so when the load is relieved, in particular when the teething element 3 is pushed to the front of the mouth, the end areas 2 are gradually pulled apart and finally revert to the rest position, with the end areas 2 being separated by the narrow gap 6 after reaching the location in the mouth where they are substantially congruent with the jaw.

To guarantee sufficient elasticity of the arc-shaped teething element and to ensure a pleasant teething experience, it is beneficial if the teething element 3 is comprised of a hollow body 7 filled with a liquid, which is preferably made of plastic, especially polyolefins, thermoplastic elastomers, polyvinylidene chloride or silicone. In order to avoid endangering the infant when the hollow body 7 is damaged and the liquid flows into the mouth of the infant by accident, a liquid non-hazardous to health, especially water, is used. The rigidity of the teething element 3 is mainly dependent on the plastic material used for the hollow body 7 and/or the volume of liquid in the hollow body 7.

Figure 2:
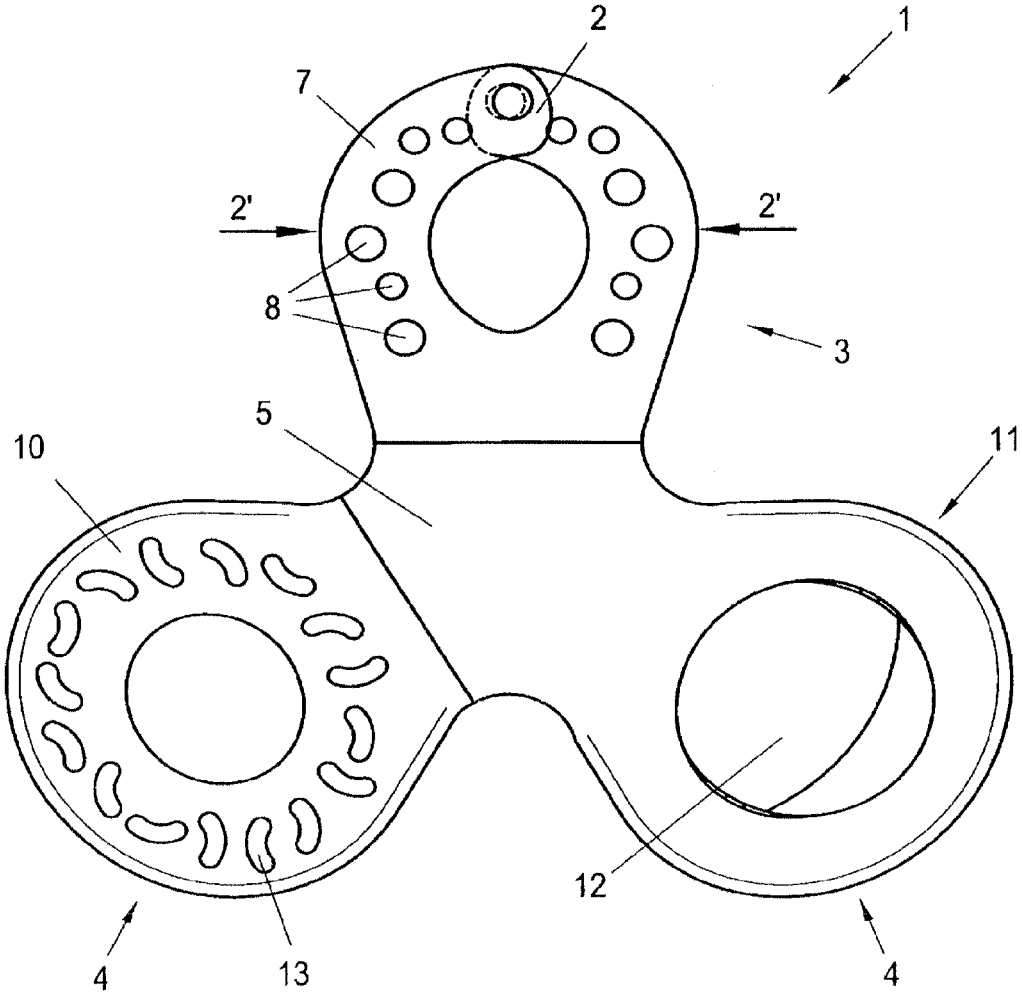
FIG. 2 shows a plan view of the teething device according to FIG. 1, with the arc-shaped teething element in a loaded securing position and having overlapping end areas.
Figure 3:
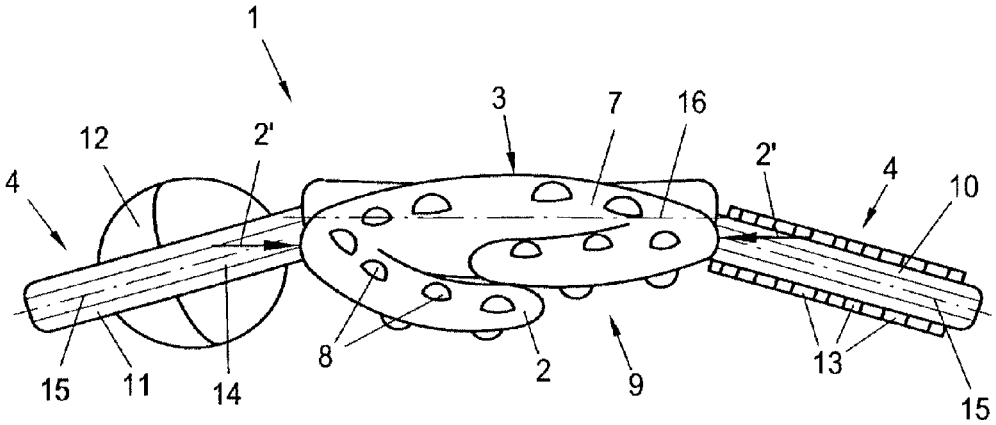
FIG. 3 shows a side view of the teething device according to FIG. 2.
Figure 4:
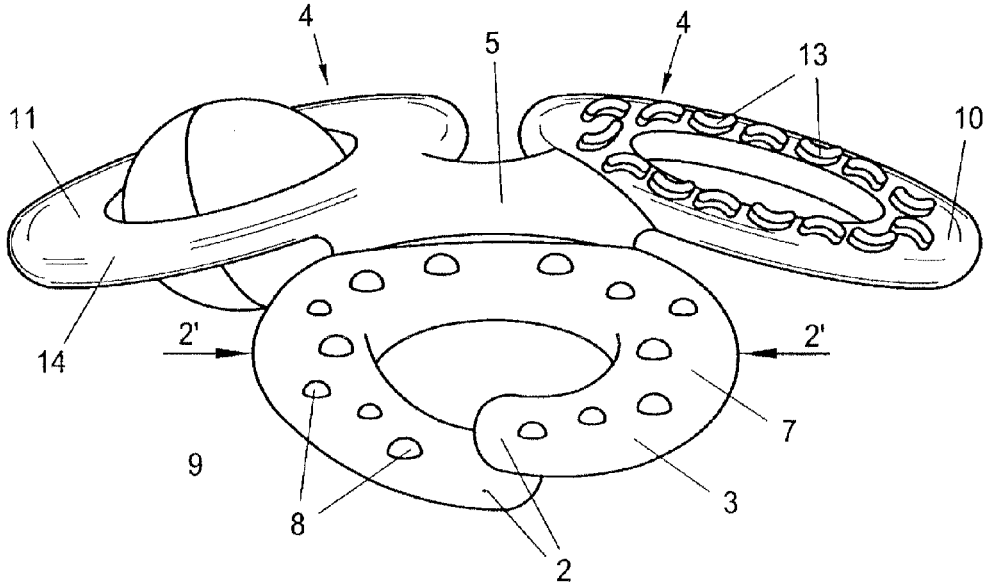
FIG. 4 shows a perspective view of the teething device according to FIG. 2 and/or FIG. 3.

The teething element 3 formed by a hollow body 7 filled with a liquid is elastically deformable to such a degree that an approximation and/or displacement of the free end areas 2 from their rest position already occurs when a comparably small lateral load is applied from the direction that is illustrated by arrows in FIGS. 2 to 4.

As can best be seen in the side view according to FIG. 3, structural elements in the form of dome-shaped protrusions or knobs 8 are provided on the surface of the teething element 3 to facilitate dentition and enhance the teething experience for the infant. The structural elements are formed integrally with the hollow body 7 and/or the teething element 3.

Various elements known from the state of the art may be provided as additional elements 4 connected to the attachment member 5. The attachment member 5, which is made of a plastic, comprises lateral slots and/or receiving elements (not illustrated in the figures), in which corresponding devices for fastening of elements 4 are fastened in a non-releasable manner; it might also be feasible, however, to provide a releasable connection such as a plug-in connection or a snap-on connection.

The teething element 3 and/or the additional elements 4 are arranged around an axis of symmetry of the attachment member 5 at regular intervals and offset by about 120° each, so an especially stable placement on a planar surface such as a table is possible.

As can best be seen in FIGS. 3 and 4, the longitudinal planes 15 of both the teething element 3 and the two additional elements 4 are arranged at angles between 130° and 170° in relation to a longitudinal plane 16 of the attachment member 5. When placing the teething device 1 on a planar surface, the attachment member 5 does thus not rest directly on the planar surface, but is offset upwards. In this way, a space 9 is formed below the attachment member 5 and/or below the teething element 3 and/or the additional elements 4, so reaching into this space and/or picking up the teething device 1 placed on the planar surface is made very easy for the user, in particular infants.

In the exemplary embodiment illustrated in the figures, a torus-shaped teething ring 10 as well as a toy element 11 in the form of a rotatably supported ball 12 are connected to the central attachment member 5.

The teething ring 10 is formed solidly and preferably more rigid than the arc-shaped teething element 3 to enable a versatile support for dentition. Elevated structural elements are provided on the surface of the teething ring 10 in the form of elongated protrusions 13.

The ball 12 of the toy element 11 is supported rotatably in an annular holder 14 formed integrally with the attachment member 5. Since the ball 12 has two surface textures in different colours, an interesting mixture of colours is provided for the infant when rotating the ball 12. The toy element 11 is intended mainly to make the infant more interested in the teething device 1.

The invention claimed is:

1. A teething device for an infant, with a substantially arc-shaped and elastically deformable teething element having two free end areas spaced apart from each other in an unloaded rest position, wherein the teething element forms a free gap between the end areas in the unloaded rest position and the teething element is substantially circular annular, wherein the arc-shaped teething element substantially simulates a shape of a jaw in such a way that, when it is inserted into a mouth and is substantially congruent with the jaw, the end areas are arranged in an area of molars in the unloaded rest position of the teething element, wherein the free gap has an opening angle of between 15° and 35°, measured from an apex of an interior wall of the opening, and the arc-shaped teething element is elastically deformable and configured such that the two end areas can be arranged at least partially overlapping each other in a securing position when a lateral load is applied to the free end areas of the teething element.

2. The teething device according to claim 1, wherein the free gap has an opening angle of substantially 22°.

3. The teething device according to claim 1, wherein elevated structural elements, in particular knobs or elongated protrusions, are formed on the teething element.

4. The teething device according to claim 1, wherein the teething element is a hollow body.

5. The teething device according to claim 4, wherein the hollow body is made of a plastic selected from a group consisting of poly-olefins, thermoplastic elastomers, polyvinylidene chloride and silicone.

6. The teething device according to claim 4, wherein the hollow body is filled with a liquid, in particular gel.

7. The teething device according to claim 6, wherein water is provided as the liquid.

8. The teething device according to claim 1, wherein the arc shaped teething element is arranged on a central attachment member together with at least two additional elements, wherein longitudinal planes of both the teething element and the two additional elements are arranged at an angle other than 180° in relation to a longitudinal plane of the attachment member.

9. The teething device according to claim 8, wherein a teething ring is provided as one of the additional elements.

10. The teething device according to claim 9, wherein the teething ring is formed solidly.

11. The teething device according to claim 8, wherein a toy element in the form of a rotatably supported ball is provided as one of the additional elements.

12. The teething device according to claim 8, wherein the attachment member, the arc-shaped teething element and at least portions of the additional elements are formed as two-component or multi-component injection molded parts.

13. A method of using a substantially circular annular teething device for an infant, the teething device having a substantially arc-shaped and elastically deformable teething element with two free end areas spaced apart from each other, comprising:

inserting the teething device in an unloaded rest position in a mouth of the infant substantially congruent with a jaw of the infant, wherein the teething element forms a free gap between the end areas in the unloaded rest position and wherein the teething element substantially simulates a shape of the jaw of the infant, wherein the free gap has an opening angle of between 15° and 35°, measured from an apex of an interior wall of the opening, arranging two end areas of the teething element in an area of molars of the infant by at least partially overlapping the two end areas in a securing position when a lateral load is applied to the teething element as it is pushed deeper into a throat area of the infant from the unloaded rest position of the teething element.

* * * * *